US011674095B2

(12) United States Patent
Koseoglu et al.

(10) Patent No.: US 11,674,095 B2
(45) Date of Patent: Jun. 13, 2023

(54) PROCESS OF REFORMING DIESEL FEEDSTOCK

(71) Applicant: SAUDI ARABIAN OIL COMPANY, Dhahran (SA)

(72) Inventors: Omer Refa Koseoglu, Dhahran (SA); Ashok Kumar Punetha, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/653,732

(22) Filed: Mar. 7, 2022

(65) Prior Publication Data

US 2022/0186127 A1 Jun. 16, 2022

Related U.S. Application Data

(63) Continuation of application No. 16/710,946, filed on Dec. 11, 2019, now Pat. No. 11,312,913.

(51) Int. Cl.
*C10G 65/12* (2006.01)

(52) U.S. Cl.
CPC ..... *C10G 65/12* (2013.01); *C10G 2300/1055* (2013.01); *C10G 2300/301* (2013.01); *C10G 2300/305* (2013.01); *C10G 2300/4006* (2013.01); *C10G 2300/4012* (2013.01); *C10G 2300/4018* (2013.01); *C10G 2300/70* (2013.01); *C10G 2400/02* (2013.01)

(58) Field of Classification Search
CPC ..... C10G 65/12; C10G 2300/1055; C10G 2300/301; C10G 2300/305; C10G 2300/4006; C10G 2300/4012; C10G 2300/4018; C10G 2300/70; C10G 2400/02; C10G 47/02; C10G 47/18; C10G 47/14; C10G 2300/1051
See application file for complete search history.

(56) References Cited

U.S. PATENT DOCUMENTS

| | | | | |
|---|---|---|---|---|
| 4,990,239 | A * | 2/1991 | Derr, Jr. | C10G 47/00 208/68 |
| 7,169,291 | B1 * | 1/2007 | Wang | C10G 47/16 208/109 |
| 7,384,542 | B1 * | 6/2008 | Thakkar | C10G 65/14 208/213 |
| 2007/0084753 | A1 * | 4/2007 | Iki | B01J 23/883 208/143 |
| 2010/0116712 | A1 * | 5/2010 | Dziabala | C10G 65/12 208/57 |

OTHER PUBLICATIONS

International Preliminary Report on Patentability issued in corresponding International Application No. PCT/US2020/014975, dated Jun. 23, 2022 (6 pages).

* cited by examiner

*Primary Examiner* — Randy Boyer
*Assistant Examiner* — Juan C Valencia
(74) *Attorney, Agent, or Firm* — Osha Bergman Watanabe & Burton LLP

(57) ABSTRACT

A process of reforming a diesel feedstock to convert diesel to a gasoline blending component may include desulfurizing and denitrogenizing the diesel feedstock to reduce the sulfur and nitrogen content; and then hydrocracking the diesel feedstock over a metal containing zeolitic catalyst to produce an isomerate fraction. The diesel feedstock may have boiling points ranging from 200 to 360° C.

17 Claims, 2 Drawing Sheets

PROCESS OF REFORMING DIESEL FEEDSTOCK

BACKGROUND

The discharge into the atmosphere of sulfur compounds during processing and end-use of the petroleum products derived from sulfur-containing sour crude oil poses health and environmental problems. The reduced-sulfur specifications applicable to transportation and other fuel products have impacted the refining industry, and as a result it has becoming exceedingly necessary for refiners to invest more heavily in efforts to reduce the sulfur content in products to 10 parts per million by weight (ppmw) or less.

To keep pace with recent trends toward production of ultra-low sulfur fuels, refiners must choose among the processes or crude oils that provide flexibility to ensure future specifications are met with minimum additional capital investment, in many instances by utilizing existing equipment. For example, technologies such as hydrocracking and multi-stage hydrotreating offer solutions to refiners for the production of clean transportation fuels. These technologies are available and can be applied as new grassroots production facilities are constructed. However, it is very difficult to upgrade existing hydrotreating reactors in these facilities because of the comparatively more severe operational requirements (i.e., higher temperature and pressure) to obtain clean fuel production. Available retrofitting options for refiners include elevation of the hydrogen partial pressure by increasing the recycle gas quality, utilization of more active catalyst compositions, installation of improved reactor components to enhance liquid-solid contact, the increase of reactor volume, and the increase of the feedstock quality.

Hydrocracking processes are used commercially in a large number of petroleum refineries. They are used to process a variety of feeds boiling in the range of 370° C. to 520° C. in conventional hydrocracking units and boiling at 520° C. and above in the residue hydrocracking units. In general, hydrocracking processes split the molecules of the feed into smaller, i.e., lighter, molecules having higher average volatility and economic value. Additionally, hydrocracking processes typically improve the quality of the hydrocarbon feedstock by increasing the hydrogen to carbon ratio and by removing organosulfur and organonitrogen compounds. The significant economic benefit derived from hydrocracking processes has resulted in substantial development of process improvements and more active catalysts.

Conventional hydrocracking processes may include single-stage once through hydrocracking, series-flow hydrocracking with or without recycle, and two-stage recycle hydrocracking. Single-stage once through hydrocracking is the simplest of the hydrocracker configurations and typically occurs at operating conditions that are more severe than hydrotreating processes, and less severe than conventional full pressure hydrocracking processes.

Single stage hydrocracking is often designed to maximize mid-distillate yield over a single or dual catalyst systems. Dual catalyst systems are used in a stacked-bed configuration or in two different reactors. The effluents are passed to a fractionator column to separate the $H_2S$, $NH_3$ light gases (C1-C4), naphtha and diesel products boiling in the temperature range of 36-370° C. The hydrocarbons boiling above 370° C. are unconverted bottoms that, in single stage systems, are passed to other refinery operations.

Series-flow hydrocracking with or without recycle is one of the most commonly used configuration. It uses one reactor (containing both treating and cracking catalysts) or two or more reactors for both treating and cracking reaction steps. Unconverted bottoms from the fractionator column are recycled back into the first reactor for further cracking. This configuration converts heavy crude oil fractions, i.e., vacuum gas oil, into light products and has the potential to maximize the yield of naphtha, jet fuel, or diesel, depending on the recycle cut point used in the distillation section. Two-stage recycle hydrocracking uses two reactors and unconverted bottoms from the fractionation column are recycled back into the second reactor for further cracking. Since the first reactor accomplishes both hydrotreating and hydrocracking, the feed to second reactor is virtually free of ammonia and hydrogen sulfide. This permits the use of high performance zeolite catalysts which are susceptible to poisoning by sulfur or nitrogen compounds.

These processes and techniques have been utilized conventionally in the art for the production of middle distillates and have resulted in a surplus of diesel oil production.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a process of reforming a diesel feedstock to convert diesel to a gasoline blending component. The process may include desulfurizing and denitrogenizing the diesel feedstock to reduce the sulfur and nitrogen content; and then hydrocracking the diesel feedstock over a metal containing zeolitic catalyst.

In another aspect, embodiments disclosed here relate to a process of reforming a diesel feedstock to convert diesel to a gasoline blending component. The process may include hydrocracking the diesel feedstock, which has boiling points ranging from 150 to 420° C., over a metal containing catalyst to produce an isomerate fraction.

Other aspects and advantages of the claimed subject matter will be apparent from the following description and the appended claims.

DETAILED DESCRIPTION

Figure 1:
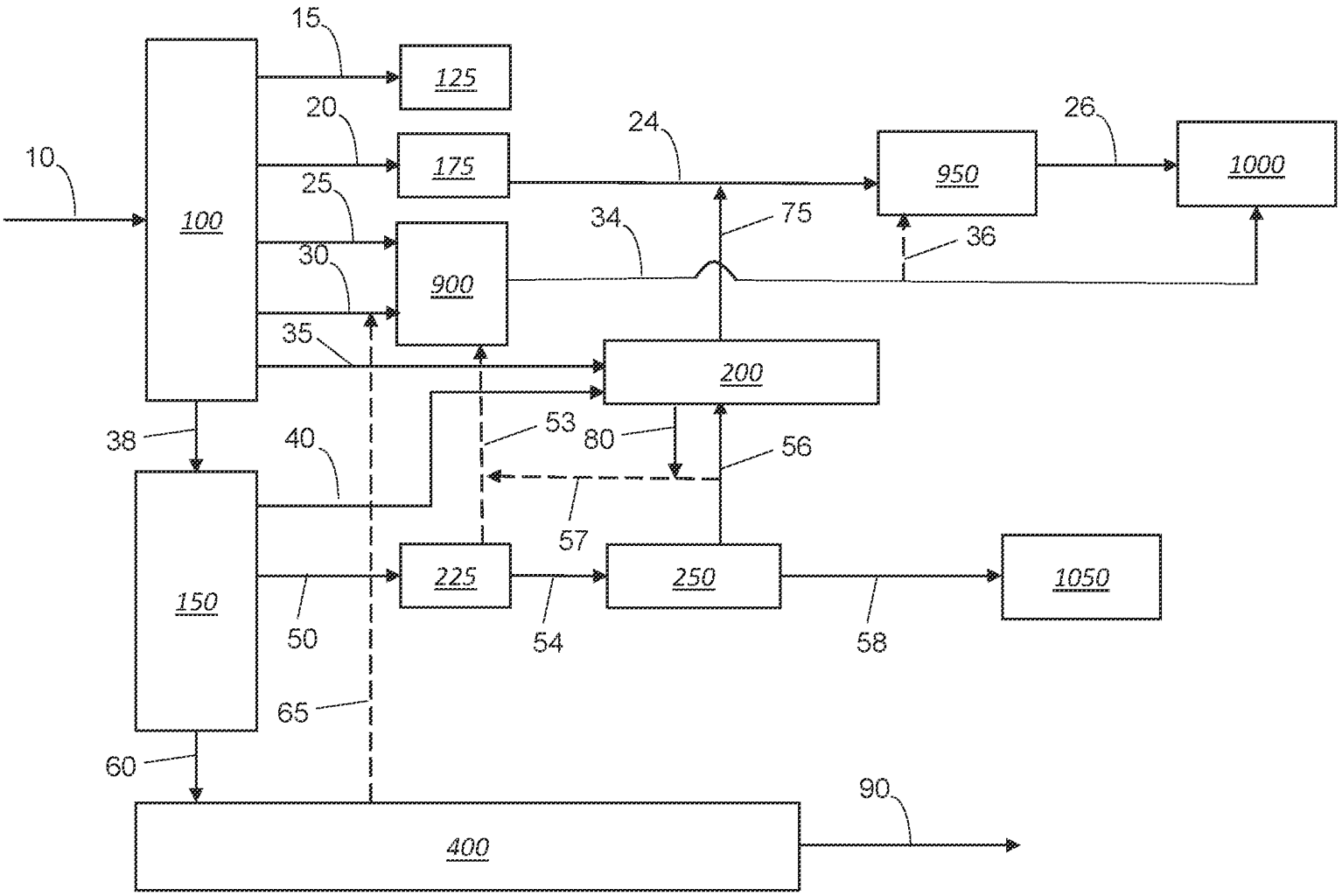
FIG. 1 depicts a process and system comprising hydrocracking unit(s) in accordance with one or more embodiments of the present disclosure.

Embodiments in accordance with the present disclosure generally relate to a process and system that includes converting and upgrading a middle distillate oil feedstock. As used herein, a middle distillate refers to a range of refined petroleum products obtained in the "middle" boiling range from about 180° C.-360° C. during the process of crude oil These processes may include hydrocracking the middle distillate oil feedstock over a metal catalyst to produce an isomerate fraction. In one or more embodiments, the distillate oil feedstock may be hydrodesulfurized and/or hydrodenitrogenized prior to being hydrocracked in order to reduce the sulfur and nitrogen content of the middle distillate oil feedstock. In one or more embodiments, the isomerate fraction may be further treated in a dehydrogenation reactor or a full catalytic reforming unit where the produced paraffins may undergo dehydrocyclization to cyclize the products of the produced isomerate fraction.

Thus, embodiments of the present disclosure are directed to converting diesel to gasoline. Because diesel is a desirable fuel, it is not conventionally hydrocracked or catalytically cracked. Rather, conventional hydrocracking processes were developed to convert heavy oil fractions as opposed to middle distillate fractions due to the high demand for middle distillates such as diesel oil. Therefore, considering that there will be a diesel surplus in the market and growing demand for chemicals, the present disclosure advantageously provides for the conversion of diesel to gasoline and/or a high quality gasoline blending products through hydrocracking.

Diesel is a middle distillate, largely produced from fractional distillation of crude oil between 200° C. and 360° C. Compositionally, diesel may include C9-C25 hydrocarbons, with a majority of the constituents being C12-C20, and an average at C15-C17.

However, it is also envisioned that the hydrocracker feed of the present disclosure may more broadly encompass distillates that boil in the range of 100 to 420° C., such as having a lower limit of 100, 150, 180, or 200° C. and an upper limit of any of 350, 360, 375, 400, and 420° C., particularly which are commonly referred to as light gas oils. While diesel is largely produced from distillation at 200° C. and 360° C., diesel is also produced from heavier fractions, including atmospheric gas oils, vacuum gas oils, and coker distillates, and it is envisioned that the feed to the hydrocracker may include downstream products from atmospheric gas oils, vacuum gas oils, and coker distillates. However, it is also appreciated that lighter fractions may also form part of the present feed. Thus, in one or more embodiments, the feed to a hydrocracker, as described herein, may be a feed that has been previously processed to arrive at the feed to the hydrocracker described herein. For example, for a majority of diesel that is produced from a middle distillate fractioned between 150 and 420° C. (or 200° C. and 360° C. in some embodiments or 250° C. and 350° C. in more particular embodiments), such distillate may b hydrotreated prior to feeding the middle distillate to a hydrocracker.

In one or more embodiments, the hydrocracker feed may be the middle distillates (distillates between150° C. and 420° C. or 200° C. and 360° C., more particularly) from the fractional distillation of crude oil, and a hydrotreating unit to which the middle distillates are sent may be a two-stage unit having hydrotreating in a first stage and hydrocracking in a second stage. The hydrotreating may be performed in the presence of a hydrotreating catalyst to significantly reduce the sulfur and nitrogen content of the feedstock, which may be referred to as hydrodesulfurization and hydrodenitrification. During hydrotreating processes, unsaturated hydrocarbons such as olefins, alkynes and aromatics may also become saturated through reaction with hydrogen. Following hydrotreating and prior to hydrocracking, $H_2S$ and $NH_3$ produced in the hydrodesulfurization and hydrodenitrification may be separated from the hydrotreated effluent along with any light gases. The remaining effluent may be directed to the hydrocracker. In one or more embodiments, the effluent's sulfur content is less than 500 ppmw, preferably 50 ppmw, most preferably less than 10 ppmw.

Further, in another embodiment, it is also envisioned that the feedstock may also include components that were processed from a heavier distillate that was subjected to one or more processing, such as vacuum gas oil being subjected to catalytic hydrocracking, to arrive at a feed for the present hydrocracking. Thus, it is envisioned that the feed to the present hydrocracking may include, in addition to middle distillates (as described above), the feed to the hydrocracker may include downstream products from atmospheric gas oils, vacuum gas oils, and coker distillates. For example, it is envisioned that the feed may include the diesel pool formed in a conventional refinery.

The hydrocracking processes generally break the molecules of a feedstock (whether limited to middle distillates or including downstream products from heavier distillates) into smaller, i.e. lighter, molecules that may have a having higher average volatility and economic value than the feedstock. Thus, hydrocracking processes in accordance with the present disclosure generally comprise combining a distillate oil feed, such as described above, with hydrogen gas, and subjecting the mixture to elevated temperatures in the presence of a hydrocracking catalyst.

In one or more embodiments, the hydrocracking catalyst includes any one of or a combination including a zeolite and/or a post modified zeolite catalyst, a metal containing zeolite, an unsupported metal catalyst, or a combination thereof. For example, the hydrocracking catalyst may include ultra-stable USY type zeolite or post modified USY zeolite, Metals may include noble metals, i.e., Ru, Rh, Pd, Ag, Os, Ir, Pt, and Au, with Pt and Pd being preferred. An unsupported metal catalyst according to the present disclosure may include an active phase material including, in certain embodiments, any one of or combination including Ni, W, Mo, Co, or a combination thereof.

In one or m ore embodiments, the hydrocracking unit use a reaction temperature of about 250° C. to about 450° C., in certain embodiments about 300° C. to about 400° C.; a hydrogen partial pressure of less than 90 bars, in certain embodiments less than about 80 bars, and in further embodiments less than about 60 bars; a liquid hourly space velocity LHSV of about 0.1 $h^{-1}$ to about 10 $h^{-1}$, in certain embodiments about 0.25 $h^{-1}$ to about 5 $h^{-1}$, and in further embodiments about 0.5 $h^{-1}$ to about 2 $h^{-1}$; and a hydrogen/oil ratio of about 500 standard Lt per Lt (StLt/Lt) to about 2500 StLt/Lt, in certain embodiments about 800 StLt/Lt to about 2000 StLt/Lt, and in further embodiments about 1000 StLt/Lt to about 1500 StLt/Lt.

In accordance with one or more embodiments described here, the hydrocracking process is accomplished over a metal catalyst, such as those described above to convert the middle distillate feedstock, such as a diesel oil feedstock, to an isomerate fraction stream as gasoline blending components. In one or more embodiments, the specific selection of the catalyst, in combination with the process conditions described herein, may allow hydrocracking of the middle distillate feed to occur in combination with hydrogenating aromatics to naphthenes, as well as the cracking and subsequent isomerization of normal paraffins to iso-paraffins to simultaneously to produce an isomerate fraction rich in high octane gasoline components.

In one or more embodiments, the hydrocracked effluent maybe an isomerate product stream comprising gasoline blend components, where the produced isomerate product stream has an octane number greater than 55 in certain embodiments, greater than 60 in another embodiment, and greater than 70 in yet another embodiment. the hydrocracking isomerate product stream may be sent to catalytic reforming (including, for example dehydrogenation to increase the aromaticity of the sample by converting iso-paraffins to naphthenes and then naphthenes to aromatics)

and as a result, the research octane number may be increased by 10 or more points in certain embodiments, 15 or more points in more particular embodiments, and 20 or more points in even more particular embodiments. For example, the hydrocracking product stream may be sent to catalytic reforming unit for paraffin cyclization and dehydrogenation, such that the octane number of the catalytically reformed final product may be 93 or greater, 95 or greater, or even 100 of greater.

Referring now to FIG. 1, a process flow diagram according to one or more embodiments of the present disclosure is shown. While the present disclosure focuses on the upgrading of diesel by hydrocracking (as described above), the present figure is provided to show the modifications that can be made to an existing refinery to convert jet/diesel hydrotreating units to perform the presently described hydrocracking to convert diesel surplus into gasoline.

As shown in FIG. 1, crude oil 10 is introduced to distillation column 100. Crude oil 10 may be any source of crude oil and distillation column 100 can be any type of separation unit capable of separating a hydrocarbon stream (specifically crude oil 10) into component parts, based on targeted cut points of distillation. An example of distillation column 100 includes an atmospheric distillation column. Distillation column 100 can be operated to separate acid gas, naphtha, kerosene/jet, (light) gas oil, and atmospheric distillate residue 38 that may be directed to vacuum distillation column 150. Vacuum distillation column 150 can be employed to separate difference vacuum gas oils such as light vacuum gas oil, heavy vacuum gas oil, and vacuum residue, under vacuum conditions.

As shown in FIG. 1, distillation column 100 can produce, for example, acid gas 15, light fraction (naphtha) stream 20, jet/kerosene 25, light gas oil 30, heavy gas oil 35, and atmospheric distillate residue 38. Vacuum distillation column 150 can produce, for example, light vacuum gas oil 40, heavy vacuum gas oil 50, and vacuum residue stream 60. In one or more embodiments light fraction stream 20 can have a T95% cut point of less than 240° C. Light fraction stream 20 can contain naphtha. Acid gas stream 15 may be distilled and directed to a gas treating unit 125. Acid gas generated during crude oil and natural gas processing typically includes hydrogen sulfide and other undesirable compounds. The removal of acid gas via acid gas stream 15 reduces components such as hydrogen sulfide, carbon dioxide (CO2), carbonyl sulfide (COS), carbon disulfide ($CS_2$) and mercaptans (RSH) from gas and liquid hydrocarbon streams.

Light fraction stream 20 may be directed to a naphtha hydrotreating unit 175 to produce treated light fraction fluid stream 24. Treated light fraction fluid stream 24 is directed to catalytic reformer and/or isomerization unit 950 to produce reformed product stream 26 that is then introduced to gasoline pool 1000.

Jet/kerosene stream 25 may have a cut point in the range of 180 to 260° C., for example, and light gas oil 30 can have a T95% cut point in the range between 340° C. and 380° C. The jet/kerosene stream 25 and light gas oil stream 30 is directed to diesel hydrocracking unit 900. While streams 25, 30 would conventionally be directed to a jet/diesel hydrotreater for hydrodesulfurization and hydrodenitrogenation to reduce the sulfur and/or nitrogen content prior to feeding the effluent into a diesel pool, in accordance with embodiments of the present disclosure, streams 25, 30 are directed to diesel hydrocracking unit 900. Diesel hydrocracking unit 900 comprises a hydrotreating reactor, separation unit, and hydrocracking reactor. The separation unit may include, for example, a flash drum, gas-liquid separators and/or stripping columns and/or fractionation to remove dissolved gases such as hydrogen sulfide and ammonia from the hydrotreated effluent.

In the first stage of the diesel hydrocracking unit 900, the jet/kerosene stream 25 and light gas oil 30 are subjected to hydrodesulfurization and hydrodenitrogenationin the hydrotreating reactor to reduce/remove sulfur and nitrogen. In one or more embodiments of the present disclosure, a hydrotreating reactor may operate at temperatures in the broad range of 250° C. to 450° C., and preferably between 300° C. to 450° C. Reaction zone pressures may be in the broad range of about 25 bar to about 250 bar, and the hydrogen partial pressure may be between 35 and 100 bar. Contact times usually correspond to liquid hourly space velocities (LHSV) in the range of about 0.2 $hr^{-1}$ to 6.0 $hr^{-1}$, preferably between about 0.2 $hr^{-1}$ and 4.0 $hr^{-1}$. The space velocity may be dependent upon the feedstock composition.

In one or more embodiments of the present disclosure, the hydrotreating catalyst may be any suitable catalyst that is known to one of ordinary skill in the art. Hydrotreating catalysts of some embodiments may comprise one or more metals selected from the group consisting of molybdenum, tungsten, iron, cobalt, and nickel. The active metals may be supported to provide a greater surface area. More than one type of hydrotreating catalyst may be used in the same reactor. In some embodiments, that are not shown, multiple hydrotreating reactors may be used in series within a unit 900. In embodiments where multiple hydrotreating reactors are used, each reactor may be primarily directed to the removal of a different component, such as desulfurization and denitrification.

In certain embodiments in which an objective is hydrodenitrogenation, acidic alumina or silica alumina based catalysts loaded with Ni—Mo, or Ni—W active metals, or combinations thereof, are used. In embodiments in which the objective is to remove all nitrogen and to increase the conversion of hydrocarbons, silica, alumina, zeolite, or combination thereof are used as catalysts, with active metals including Ni Mo, Ni W or combinations thereof.

In diesel hydrocracking unit 900, the hydrotreated effluent stream comprising hydrotreated products from jet/kerosene stream 25 and light gas oil stream 30 is directed to a separating unit where it may be separated to remove $H_2S$, $NH_3$, and any light gases including $C_1$-$C_4$. The separated effluent including fractions with an initial nominal boiling point temperature of about 180° C. and final boiling point temperatures ranging from about 420° C. to about 500° C.) is sent to the hydrocracking reactor to undergo cracking reactions. The hydrocracking reactor may include a zeolite and/or a post modified zeolite catalyst, a metal containing zeolite, an unsupported metal catalyst, or a combination thereof.

The hydrocracking in the diesel hydrocracking unit 900 may be performed at a reaction temperature of about 250° C. to about 450° C., in certain embodiments about 300° C. to about 400° C.; a hydrogen partial pressure of less than 90 bars, in certain embodiments less than about 80 bars, and in further embodiments less than about 60 bars; a liquid hourly space velocity LHSV of about 0.1 $h^{-1}$ to about 10 $h^{-1}$, in certain embodiments about 0.25 $h^{-1}$ to about 5 $h^{-1}$, and in further embodiments about 0.5 $h^{-1}$ to about 2 $h^{-1}$; and a hydrogen/oil ratio of about 500 standard Lt per Lt (StLt/Lt) to about 2500 StLt/Lt, in certain embodiments about 800 StLt/Lt to about StLt/Lt, and in further embodiments about 1000 StLt/Lt to about 1500 StLt/Lt.

After the second stage (hydrocracking) of diesel hydrocracking unit 900, effluent 34 may include an isomerate fraction, which may be sent to a gasoline blending pool 1000, for example. It is also envisioned that, depending on the constituents present within effluent 34, effluent 34 may optionally (shown in line 36) be sent to a reforming unit 950 for reforming of the hydrocarbon species to increase the iso-paraffins and aromatics. In particular embodiments, effluent 34 may have an RON of greater than 55 in certain embodiments, greater than 60 in another embodiment, and greater than 66 in yet another embodiment. At least a portion of effluent 34 (which may include the isomerate fraction) sent via line 36 to a reformer in which cyclization followed by dehydrogenation may increase the aromaticity of the sample by converting paraffins to naphthenes and then to aromatics) and as a result, the research octane number may be increased by 10 or more points in certain embodiments, 15 or more points in more particular embodiments, and 20 or more points in even more particular embodiments. For example, the hydrocracking product stream may be sent to catalytic reforming unit for paraffin cyclization and dehydrogenation, such that the octane number of the catalytically reformed final product may be 93 or greater, 95 or greater, or even 97 of greater.

According to FIG. 1, light vacuum gas oil 40 can have a T95% cut point in the range between 400° C. and 430° C. Light vacuum gas oil 40 can be introduced to cracking unit 200, which may be, for example, a catalytic hydrocracking unit, a fluid catalytic cracking unit, etc. Hydrocracking unit 200 may also receive heavy gas oil 35. The effluent may be fractionated by fractionator unit comprised in hydrocracking unit 200 into light fraction 75 and gas oil 80. Upgraded light fraction 75 can contain the naphtha range hydrocarbons and kerosene range hydrocarbons present in light vacuum gas oil 40. Upgraded light fraction 75 can be mixed with treated light fraction stream 24 and introduced to reforming/isomerization unit 950 prior to being directed to gasoline pool 1000. In at least one embodiment, upgraded light fraction 75 can be introduced to gasoline 1000 without first mixing with treated light fraction stream 24.

Heavy vacuum gas oil 50 can have a T95% cut point of greater than 560° C. Vacuum residue stream 60 can have a T5% cut point of greater than 560° C. Vacuum residue stream 60 contains the heaviest fraction of crude oil. Heavy vacuum gas oil 50 can be introduced to vacuum gas oil hydrotreater 225 which may comprise a hydrotreating reactor and separator. The produced effluent from the hydrotreating reactor of hydrotreating unit 225 can be separated to remove gas oils which may be directed to the diesel hydrocracking reactor 900 via stream 53. Treated heavy vacuum gas oil stream 54 can be fed to catalytic cracking unit 250, which may be, for example, a catalytic hydrocracking unit, a fluid catalytic cracking unit, etc. The effluent of catalytic cracker 250 may be separated into hydrocracked gasoline stream 58 and light cracked distillate stream 56. Hydrocracked gasoline stream 58 can then be fed to hydrocracked gasoline pool 1050 and light cracked distillate stream 56 can be fed to hydrocracker 200 with light vacuum gas oil stream 40. In one or more embodiments, light cracked distillate stream 56 may be fed directly to diesel hydrocracking unit 900 via stream 57.

In at least one embodiment, vacuum residue stream 60 is not controlled by distillation but is the remainder fraction not separated in heavy vacuum gas oil 50 in vacuum distillation column 150.

Vacuum residue stream 60 can be introduced to resid (residual) upgrading unit 400. Resid upgrading unit 400 can be any process unit capable of upgrading a heavy fraction stream. Examples of resid upgrading unit 400 include fluid catalytic cracking (FCC) unit, resid FCC, hydrocracker, resid hydrodesulfurization (RHDS) hydrotreater, visbreaker, coker, gasifier, and solvent extractor. Resid upgrading unit 400 can produce resid upgraded product 90 and gas oil stream 65 which may directed to diesel hydrocracking unit 900. Gas oil stream 65 may be directed to diesel hydrocracking unit 900 to be subjected to the hydrotreating, separation and hydrocracking steps described above.

Figure 2:
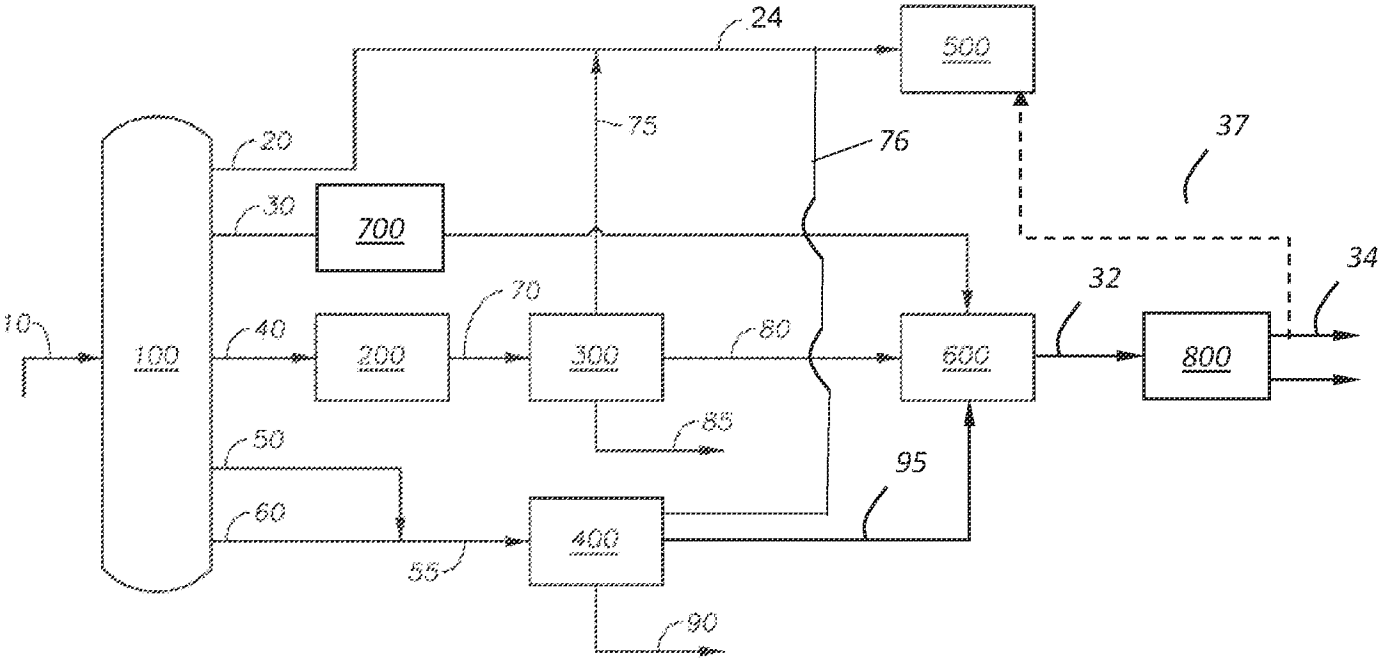
FIG. 2 depicts a process and system comprising hydrocracking unit(s) in accordance with another embodiment of the present disclosure.

Referring now to FIG. 2, a process flow diagram according another embodiment of the present disclosure is shown. While the present disclosure focuses on the upgrading of diesel by hydrotreating and hydrocracking (as described above), FIG. 2 is provided to show that the diesel being hydrocracked is not limited to distillates from a particular cut of the distillation and may include products that are formed and separated from one or more heavier distillation cuts and joined together in a diesel pool. As shown, crude oil 10 is introduced to distillation column 100. Crude oil 10 can be any source of crude oil. Distillation column 100 can be any type of separation unit capable of separating a hydrocarbon stream (specifically crude oil 10) into component parts, based on targeted cut points of distillation. An example of istillation column 100 includes an atmospheric distillation column. Distillation column 100 can be operated to separate naphtha, kerosene, light gas oil, light vacuum gas oil, and heavy vacuum gas oil.

Distillation column 100 can produce, for example, light fraction stream 20, light gas oil 30, light vacuum gas oil 40, heavy vacuum gas oil 50, and vacuum residue stream 60. In an alternate embodiment, distillation column 100 can produce a light fraction stream, a light gas oil, a light vacuum gas oil, and a heavy stream, where the heavy stream contains the heavy vacuum gas oil and the vacuum residue stream. Light fraction stream 20 can have a T95% cut point of less than 240° C. Light fraction stream 20 can contain naphtha and kerosene and can be introduced to naphtha and kerosene pool 500.

Light gas oil 30 can have a T95% cut point in the range between 340° C. and 380° C. Light gas oil 30 can be introduced to diesel pool 600 after the treatment. As, light gas oil 30 is subjected to hydrodesulfurization and hydrodenitrogenation in hydrotreating unit 700 to reduce/remove sulfur and nitrogen. In one or more embodiments of the present disclosure, a hydrotreating reaction unit 700 may operate at temperatures in the broad range of 300° to 450° C., and preferably between 300° to 400° C. Reaction zone pressures may be in the broad range of about 25 bar to about 250 bar, and the hydrogen partial pressure may be between 35 and 100 bar. Contact times usually correspond to liquid hourly space velocities (LHSV) in the range of about 0.2 $hr^{-1}$ to 6.0 $hr^{-1}$, preferably between about 0.2 $hr^{-1}$ and 4.0 $hr^{-1}$. The space velocity may be dependent upon the feedstock composition.

In one or more embodiments of the present disclosure, the hydrotreating catalyst may be any suitable catalyst that is known to one of ordinary skill in the art, as detailed above. In embodiments where multiple hydrotreating reactors are used, each reactor may be primarily directed to the removal of a different component, such as desulfurization and denitrification.

In certain embodiments in which an objective is hydrodenitrogenation, acidic alumina or silica alumina based catalysts loaded with Ni—Mo, or Ni—W active metals, or combinations thereof, are used. In embodiments in which the objective is to remove all nitrogen and to increase the conversion of hydrocarbons, silica alumina, zeolite or combination thereof are used as catalysts, with active metals including Ni Mo, Ni W or combinations thereof.

Light vacuum gas oil 40 can have a T95% cut point in the range between 400° C. and 430° C. The light vacuum gas oil stream may have a T95% cut point in the range between 400° C. and 430° C. Light vacuum gas oil 40 can be introduced to cracking unit 200, which may be, for example, a catalytic hydrocracking unit, a fluid catalytic cracking unit, etc. The effluent 70 may be fractionated by fractionator into light fraction 75, light gas oil 80 and heavy gas oil 85. Fractionator 300 can be any type of separation unit capable of separating a stream containing hydrocarbons. Examples of fractionator 300 can include a distillation column having multiple-stages of internal reflux and a flashing column. Upgraded light fraction 75 can contain the naphtha range hydrocarbons and kerosene range hydrocarbons present in vacuum gas oil 70. Upgraded light fraction 75 can be mixed with light fraction stream 20 to produce mixed light stream 24 and introduced to naphtha and kerosene pool 500. In at least one embodiment, upgraded light fraction 75 can be introduced to naphtha and kerosene pool 500 without first mixing with light fraction stream 20. Upgraded heavy fraction 85 can contain the hydrocarbons heavier than the hydrocarbons in upgraded light gas oil 80.

Heavy vacuum gas oil 50 can have a T95% cut point of greater than 560° C. Vacuum residue stream 60 can have a T5% cut point of greater than 560 deg C. Vacuum residue stream 60 contains the heaviest fraction of crude oil. In at least one embodiment, vacuum residue stream 60 is not controlled by distillation but is the remainder fraction not separated in heavy vacuum gas oil 50.

Heavy vacuum gas oil 50 and vacuum residue stream 60 can be mixed to produce mixed heavy stream 55. Mixed heavy stream 55 can be introduced to resid (residual) upgrading unit 400. Resid upgrading unit 400 can be any process unit capable of upgrading a heavy fraction stream. Examples of resid upgrading unit 400 include fluid catalytic cracking (FCC) unit, resid FCC, hydrocracker, resid hydrodesulfurization (RHDS) hydrotreater, visbreaker, coker, gasifier, and solvent extractor. Resid upgrading unit 400 can produce resid upgraded light fraction 76 (introduced to naphtha and kerosene pool 500), upgraded product 90, and diesel 95 (added to diesel pool 600).

In accordance with the present disclosure, at least a portion 32 of diesel pool 600 (which may contain any of the above identified feeds but is not limited to such feeds or required to have each feed) is sent to hydrocracker unit 800. Hydrocracker unit 800 may include a zeolite and/or a post modified zeolite catalyst, a metal containing zeolite, an unsupported metal catalyst, or a combination thereof.

The hydrocracking unit 800 may be performed at a reaction temperature of about 250° C. to about 450° C., in certain embodiments about 300° C. to about 400° C., and in further embodiments about 330° C. to about 355° C.; a hydrogen partial pressure of less than 90 bars, in certain embodiments less than about 80 bars, and in further embodiments less than about 60 bars; a liquid hourly space velocity LHSV of about 0.1 $h^{-1}$ to about 10 $h^{-1}$, in certain embodiments about 0.25 $h^{-1}$ to about 5 $h^{-1}$, and in further embodiments about 0.5 $h^{-1}$ to about 2 $h^{-i}$; and a hydrogen/oil ratio of about 500 standardized Lt per Lt (StLt/Lt) to about 2500 StLt/Lt, in certain embodiments about 800 StLt/Lt to about 2000 StLt/Lt, and in further embodiments about 1000 StLt/Lt to about 1500 StLt/Lt.

After hydrocracking unit 800, effluent 34 may include an isomerate fraction, which may be sent via line 37 to a gasoline blending pool 500, for example. It is also envisioned that the effluent 34 may be sent to a reforming unit (not shown) for reforming of the hydrocarbon species to increase the iso-paraffins and aromatics. Optionally, the effluent may be further fractioned to separate the isomerate fraction from the effluent prior to being subjected to any additional reforming. While effluent 34 may have an RON of greater than 55 in certain embodiments, greater than 60 in another embodiment, and greater than 66 in yet another embodiment. At least a portion of effluent 34 (which may include the isomerate fraction) sent to a reformer in which dehydrogenation may increase the aromaticity of the sample by converting naphthenes to aromatics) and as a result, the research octane number may be increased by 10 or more points in certain embodiments, 15 or more points in more particular embodiments, and 20 or more points in even more particular embodiments. For example, the hydrocracking product stream may be sent to catalytic reforming unit for paraffin cyclization and dehydrogenation, such that the octane number of the catalytically reformed final product may be 93 or greater, 95 or greater, or even 97 of greater.

EXAMPLES

The following examples are merely illustrative and should not be interpreted as limiting the scope of the present disclosure.

To illustrate the present process, Example 1 shows a hydrocracking pilot plant test that was conducted using a deeply hydrodesulfurized diesel oil as a feedstock. The hydrodesulfurized diesel oil feedstock properties are shown in Table 1.

TABLE 1

| Property | Unit | Value |
|---|---|---|
| Density @ 15.6° C. | g/cc | 0.83 |
| SULFUR | ppmw | <10 |
| Nitrogen ASTM D-4629 | ppmw | 21.00 |
| Simulated Distillation D2887 | | |
| 0 W % | ° C. | 110 |
| 5 W % | ° C. | 177 |
| 10 W % | ° C. | 203 |
| 30 W % | ° C. | 255 |
| 50 W % | ° C. | 287 |
| 70 W % | ° C. | 318 |
| 90 W % | ° C. | 362 |
| 95 W % | ° C. | 379 |
| 100 W % | ° C. | 414 |
| 2D GC | W % | |
| Paraffins | W % | 52.68 |
| Naphtenes | W % | 25.26 |
| Mono-Aromatics | W % | 19.45 |
| Di-Aromatics | W % | 2.61 |

The feedstock shown in Table 1 were subjected to hydrocracking which occurred in a hydrocracking reactor at 60 bars of hydrogen partial pressure, 355° C. of temperature, an LHSV of 1 $h^{-1}$ and a hydrogen to gas oil ratio of 1,000 StLt/Lt. The catalyst employed in this experiment was a zeolite containing catalyst with platinum on it as an active phase metal.

The diesel oil feedstock of Example 1 and product distillation of the resulting hydrocracked product data are shown in Table 2. As seen, the diesel is fully converted to an isomerate fraction comprising gasoline range products.

TABLE 2

| W % off | | Feedstock | Products |
|---|---|---|---|
| 0 W % | ° C. | 110 | 34 |
| 5 W % | ° C. | 177 | 59 |
| 10 W % | ° C. | 203 | 69 |
| 30 W % | ° C. | 255 | 89 |
| 50 W % | ° C. | 287 | 103 |
| 70 W % | ° C. | 318 | 119 |
| 90 W % | ° C. | 362 | 141 |
| 95 W % | ° C. | 379 | 149 |
| 100 W % | ° C. | 414 | 186 |

The produced products were analyzed using PIONA analysis to identify the n-paraffins, iso-paraffins, olefins, naphthenes, and aromatics, and the research octane number was calculated from this data. The PIONA analysis of the produced products revealed 14.3 W % normal paraffins, 52.1 W % iso-paraffins, 28.8 W % of naphthenes and 3.5 W % of aromatics. Thus, the process in accordance with the one demonstrated in Example 1, may sufficiently serve to simultaneously hydrocracking the diesel oil feedstock, hydrogenating the aromatics to naphthenes, cracking naphthenes and subsequently isomerizing naphthenes to result in a final isomerate fraction with greater than 50 W % iso-paraffins.

The calculated research octane number of the produced product was 66. Additionally, the hydrocracking product stream may be sent to a dehydrogenation reactor to increase the aromaticity of the sample and as a result, the research octane number may be increased by about 19 points. At full dehydrogenation, the octane number is calculated to be 85. If the stream is sent to full catalytic reforming unit for paraffin cyclization and dehydrogenation, the octane number of the final product is 97.

Accordingly, the process of the present application may be advantageously employed to upgrade middle distillate oil feedstock such as diesel to improve the yield of gasoline blending components, particularly when diesel is in surplus.

Although the preceding description has been described herein with reference to particular means, materials and embodiments, it is not intended to be limited to the particulars disclosed herein; rather, it extends to all functionally equivalent structures, methods and uses, such as are within the scope of the appended claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A process of reforming a diesel feedstock to convert diesel to a gasoline blending component, comprising:

desulfurizing and denitrogenizing the diesel feedstock to reduce a sulfur and nitrogen content, wherein the diesel feedstock consists of diesel oil that boils in a range from about 180 to 375° C.;

hydrocracking the diesel feedstock over a metal containing zeolitic catalyst, thereby fully converting the diesel oil to the gasoline blending component.

2. The process of claim 1, wherein the metal containing zeolitic catalyst comprises a noble metal.

3. The process of claim 2, wherein the noble metal is one or more selected from the group consisting of platinum, palladium, ruthenium, and gold.

4. The process of claim 1, wherein the hydrocracking occurs in a hydrocracking reactor that operates at a temperature in the range of 250 to 450° C.

5. The process of claim 1, wherein a hydrocracking reactor is operated at an operating pressure of less than 60 bars.

6. The process of claim 1, wherein a hydrocracking reactor is operated at an LHSV in a range of 0.5 to 5 h−1.

7. The process of claim 1, wherein the metal containing zeolitic catalyst is a modified zeolite catalyst.

8. The process of claim 1, wherein the hydrocracking of the diesel feedstock produces an isomerate fraction comprising gasoline blending components.

9. The process of claim 8, wherein the produced isomerate fraction comprises an octane number of greater than 60.

10. A process of reforming a diesel feedstock to convert diesel to a gasoline blending component, comprising:

desulfurizing and denitrogenizing the diesel feedstock to reduce a sulfur and nitrogen content, wherein a sulfur content of the diesel feedstock is reduced to less than 500 ppmw in the desulfurizing step;

hydrocracking the diesel feedstock over a metal containing zeolitic catalyst, thereby fully converting the diesel feedstock to the gasoline blending component.

11. The process of claim 10, wherein the sulfur content of the diesel feedstock is reduced to less than 10 ppmw in the desulfurizing step.

12. A process of reforming a diesel feedstock to convert diesel to a gasoline blending component, comprising:

hydrocracking the diesel feedstock over a metal containing catalyst, the diesel feedstock having boiling points ranging from 180 to 375° C. to fully convert the diesel feedstock to produce an isomerate fraction as the gasoline blending component, wherein the isomerate fraction comprises greater than 50 W % iso-paraffins.

13. The process of claim 12, wherein the metal containing catalyst comprises a noble metal selected from the group consisting of platinum, palladium, ruthenium, and gold.

14. The process of claim 12, wherein the isomerate fraction comprises an octane number of greater than 60.

15. The process of claim 12, further comprising: desulfurizing and denitrogenizing the diesel feedstock prior to the hydrocracking.

16. The process of claim 12, wherein the produced isomerate fraction comprises n-paraffins and naphthenes.

17. The process of claim 16, further comprising: reforming the n-paraffins and the naphthenes present in the isomerate fraction.

* * * * *